US008544695B2

(12) United States Patent
Gordon

(10) Patent No.: US 8,544,695 B2
(45) Date of Patent: Oct. 1, 2013

(54) SUPPORT MEMBER WITH A "SQUEEZE TO USE" BOTTLE OF GEL/LIQUID

(76) Inventor: Michael John Gordon, Farnham Royal (GB)

( * ) Notice: Subject to any disclaimer, the term of this patent is extended or adjusted under 35 U.S.C. 154(b) by 125 days.

(21) Appl. No.: 13/201,264

(22) PCT Filed: Feb. 12, 2010

(86) PCT No.: PCT/EP2010/051822

§ 371 (c)(1),
(2), (4) Date: Aug. 12, 2011

(87) PCT Pub. No.: WO2010/092165

PCT Pub. Date: Aug. 19, 2010

(65) Prior Publication Data

US 2011/0290825 A1 Dec. 1, 2011

(30) Foreign Application Priority Data

| | | |
|---|---|---|
| Feb. 12, 2009 | (GB) | 0902297.1 |
| Sep. 7, 2009 | (GB) | 0915524.3 |
| Nov. 24, 2009 | (GB) | 0920535.2 |

(51) Int. Cl.
*B67D 7/06* (2010.01)

(52) U.S. Cl.
USPC ..... 222/181.2; 222/180; 222/181.3; 222/213; 222/214; 222/546; 222/556; 248/205.3; 248/205.5; 248/220.21

(58) Field of Classification Search
USPC ..... 222/180, 181.1–181.3, 107, 206, 222/213–215, 546, 556, 562; 248/205.3–205.7, 248/206.2–206.3, 220.21
See application file for complete search history.

(56) References Cited

U.S. PATENT DOCUMENTS

| | | | | | |
|---|---|---|---|---|---|
| 3,180,528 | A | * | 4/1965 | Balint et al. | 222/105 |
| 4,085,867 | A | * | 4/1978 | Heller | 222/181.3 |
| 4,166,553 | A | * | 9/1979 | Fraterrigo | 222/181.2 |
| 4,203,567 | A | * | 5/1980 | Featherstone | 248/108 |
| 4,470,523 | A | * | 9/1984 | Spector | 222/181.2 |
| 4,747,519 | A | * | 5/1988 | Green et al. | 222/181.3 |
| 4,792,064 | A | * | 12/1988 | Loesel et al. | 222/181.2 |
| 4,905,873 | A | * | 3/1990 | Loesel et al. | 222/181.2 |
| 5,014,880 | A | * | 5/1991 | Loesel et al. | 222/181.2 |

(Continued)

FOREIGN PATENT DOCUMENTS

| | | | |
|---|---|---|---|
| DE | 20 2007 018 022 | U1 | 4/2008 |
| EP | 0 997 384 | A1 | 5/2000 |
| GB | 2098958 | A * | 12/1982 |
| WO | WO 2004/004529 | A1 | 1/2004 |

OTHER PUBLICATIONS

International Search Report, Jul. 2009.
Written Opinion, Jul. 2009.

*Primary Examiner* — Frederick C Nicolas
(74) *Attorney, Agent, or Firm* — Fay Sharpe LLP

(57) ABSTRACT

The invention relates to a support member and dispensing container assembly designed for a "squeeze to use" dispensing container. A support member 31 which rigidly attaches to a support structure like a wall, has a releasable attachment means 34 into which a free standing "squeeze to use" dispensing container for gels or liquids 1 can be inserted to releasably hold the container 1 to form a rigid connection whereby the dispensing aperture 3 of the dispensing container 1 faces downwards.

20 Claims, 3 Drawing Sheets

(56) References Cited

U.S. PATENT DOCUMENTS 5,673,884 A * 10/1997 Yemini ..... 248/205.5
6,688,500 B1 2/2004 Cheng
7,261,221 B2 * 8/2007 Awbrey et al. ..... 222/181.3
7,261,268 B2 * 8/2007 Kunesh et al. ..... 248/310
2006/0163285 A1 7/2006 Gerenraich
2007/0114246 A1 * 5/2007 Awbrey et al. ..... 222/181.2

* cited by examiner

SUPPORT MEMBER WITH A "SQUEEZE TO USE" BOTTLE OF GEL/LIQUID

This application is a National Stage of PCT/EP2010/051822, filed Feb. 12, 2010, and claims priority to the benefit of, Great Britain Patent Application No. 0902297.1, filed on Feb. 12, 2009, Great Britain Patent Application No. 0915524.3, filed on Sep. 7, 2009 and Great Britain Patent Application No. 090535.2, filed on Nov. 24, 2009, of which Applications are hereby incorporated by reference.

The present invention relates to a support member for a dispensing container for 'squeeze to use' bottles of liquid or gel like shampoo shower gel or even sauce bottles like tomato ketchup.

Various types of 'squeeze to use' dispensing containers are known such as shampoo bottles, and sauce bottles (e.g. tomato ketchup). Much of the time these dispensing containers can be left on a shelf or other surface when not in use, but are then picked up manually to use them. This generally requires the user to bend down, pick up the dispensing container, then hold the dispensing container with one hand while the product is being used and then put the dispensing container down again. Also these dispensing containers can take up surface space.

There is often not a convenient or secure means to accommodate these containers. For example if a shampoo bottle is placed on a shelf or around the bath tub, it can easily topple over, a bottle of gel attached to a shower cord by a hook mechanism or similar may swing around or fall if accidentally knocked or a sauce bottle may not be secure sitting on a surface in a ship's galley.

Examples of an improved method to enable these bottles to be used without confiscation of space around the tub is described in DE 20 2007 018 022 U1. The bottle features an attachment means located on the side of the bottle which enables the bottle to attach to a support member the latter being attached to a support structure like a wall. A problem with this method is that the bottle requires an external attachment which some would see as being an extra expense or complication in the production process, or one that may detract from the aesthetics of the bottle. In another embodiment of DE 20 2007 018 022 U1, the support member engages with an indent in the bottle itself in order to provide a firm engagement fit. The engagement means is therefore inserted into the cavity of the bottle, rather than the bottle being inserted into the engagement means of the support member. A problem with this method is that the indent confiscates some of the volume that the bottle provides for the gel or liquid and such an indent may detract from the aesthetics of the bottle.

Another example of an improved method to prevent dispensing containers for gels and liquids from falling that enables a user to extract product without having to hold onto the dispensing container whilst extracting product from it is described in EP 0 997 384 A1. In order to ensure that the dispensing container is held firmly within the retaining support member, the dispensing container features a projection which is first inserted into the retaining member, then the locking mechanism on the retaining member is adjusted in order to ensure that the article is locked into the retaining member. Of necessity therefore this is a two part process, one to insert the article into the retaining member, a second to adjust the locking means in order to lock the article within the retaining member. Similarly, when releasing the article from the retaining means, the locking means needs to be adjusted so as to enable the article to be released. A problem with this method is that if the dispensing container is to depend under a shelf with its dispensing end facing downwards, locking the dispensing container into the retaining mechanism will require the use of both hands. One to hold the dispensing container in position whilst the other hand adjusts the locking means to lock the dispensing container into the retaining member.

Additionally, the projection on the bottom of the dispensing container further deters its theft by rendering it unstable and non free standing, which is not a useful attribute for a domestic user. Also, the retaining support member may be both more complex and expensive to manufacture if it has an adjustable locking means built into it.

US 2003/021033 and W02004/004529 A1 disclose dispensing containers for use with a support member, or mount, to prevent theft of the dispensing container. Both US 2003/021033 and WO2004/004529 A1 disclose assembled systems which secure the container into the mount and allow the container to be rotated without causing disengagement of the container from its mount. In order to prevent theft, the body of the mount or its constituent components or its means of attachment to the support structure is invasive to the support structure. Within a domestic dwelling, this invasiveness may cause damage to the paintwork or tiling of the support structure, and removal of the mounting may leave unsightly damage to it that will require attention. Additionally various embodiments of US 2003/021033 require a locking devise, like a ball indent, to securely lock the dispensing container to its mounting. This secure locking devise then needs to be disengaged in order for the dispensing container to be removed from its mounting. Within a domestic setting, it is not required to lock the dispensing container against theft, therefore such a devise like a ball indent that performs this locking function is not an additional expense or elaboration to the support member that needs to be incurred.

Additionally, if the support member is placed within the bath or shower area this could require the user to enter the bath or the shower cubicle shower in order to remove it, the facility to replace or remove the dispensing container in a single action that only requires the dispensing container to be touched and manipulated with one hand in order for the dispensing container to be inserted into the dispensing container or released from it, would be of benefit because this would allow the user to use the other arm in order to provide stability. Better therefore if the dispensing container and the support member can be interlocked and released from each other using just one hand.

Support members already exist which are non invasive to the host support structures. US005439193A discloses a container inverting support which attaches to a vertical surface by means of suction pads. It supports the dispensing container by the neck or the portion of the container adjacent its opening. This means that the container is supported at its slimmest and thereby weakest locations, along the neck which could make it unstable. It would be more advantageous to support the container at a portion of the container with a more substantial diameter rather than the neck or the area immediately adjacent the opening of the container.

The invention seeks to provide a solution to these problems

According to the present invention there is provided a support member and dispensing container assembly for gels or liquids comprising:

a) a support member which rigidly attaches to a support structure which has an engagement means to releasably hold the container to form a rigid connection whereby the dispensing end of the container faces downwards, enabling the user unrestricted access to the sides of the container to enable product to be squeezed from the container and b) a free standing, self contained, fully sealed 'squeeze to use' dispensing container for gels or liquids featuring a dispensing aperture at one first end of the container to dispense product, which can be connected to and released from the support member solely by holding and manipulating the container relative to the support member and c) an engagement means comprising a premoulded first component on the dispensing container second end which releasably interlocks with a second component on the support member by rotating the first component relative to the second component and then unlocks by rotating the first component relative to the second component in the opposite direction, the interlocking means between the first and second components comprising a structure selected from the group consisting a key or key way, screw thread, bayonet style connector or other rotating interlocking action.

Preferably the support member and dispensing container assembly for gels or liquids features an engagement means comprising a first component on the dispensing container which inserts into the second component on the support member.

Preferably the support member and dispensing container assembly for gels or liquids features an engagement means comprising a first component on the dispensing container into which the second component on the support member can be inserted.

Preferably the support member and dispensing container assembly features a dispensing container with a surface contact means at a second end of the container opposing said first end allowing the dispensing container to stand on a surface on the surface contact means.

Preferably the support member and dispensing container assembly features a dispensing container wherein the cap on the dispensing end can be removed and firmly fitted onto the non dispensing end which then enables the dispensing container to fit into the second component to form a rigid connection.

Preferably the support member and dispensing container assembly according features an engagement means which predetermines the orientation of the dispensing container relative to the support member.

Preferably the support member and dispensing container assembly features a support member which is adapted to be mounted under a surface whereby the dispensing container can depend below the surface.

Preferably the support member and dispensing container assembly features a support member having an adhesive surface to secure the support member to a support structure.

Preferably the support member and dispensing container assembly features a support member which attaches non invasively to the support structure.

Preferably the support member and dispensing container assembly featuring a support member which can be secured to a support structure using suction pads.

Preferably the support member and dispensing container system features a support member that can be secured to a vertical surface by means of an adhesive layer or suction pads.

Preferably the support member and dispensing container assembly features a dispensing container can be inserted into the second component with a single hand.

Preferably the support member and dispensing container features a dispensing container that can be removed from the second component with a single hand.

Preferably the support member and dispensing container features a dispensing container that can be inserted into the second component with a single action.

Preferably the support member and dispensing container assembly features a dispensing container can be removed from the second component with a single action.

Preferably the support member and dispensing container assembly features a support member which may have an adhesive surface or suction pads so as to secure below a shelf or wall cabinet.

Preferably the support member and dispensing container assembly features a support member which may be one that can be secured to a vertical surface like a tiled wall by means of an adhesive layer or suction pads.

Embodiments of the invention will now be described with reference to the accompanying drawing in which.

Figure 1:
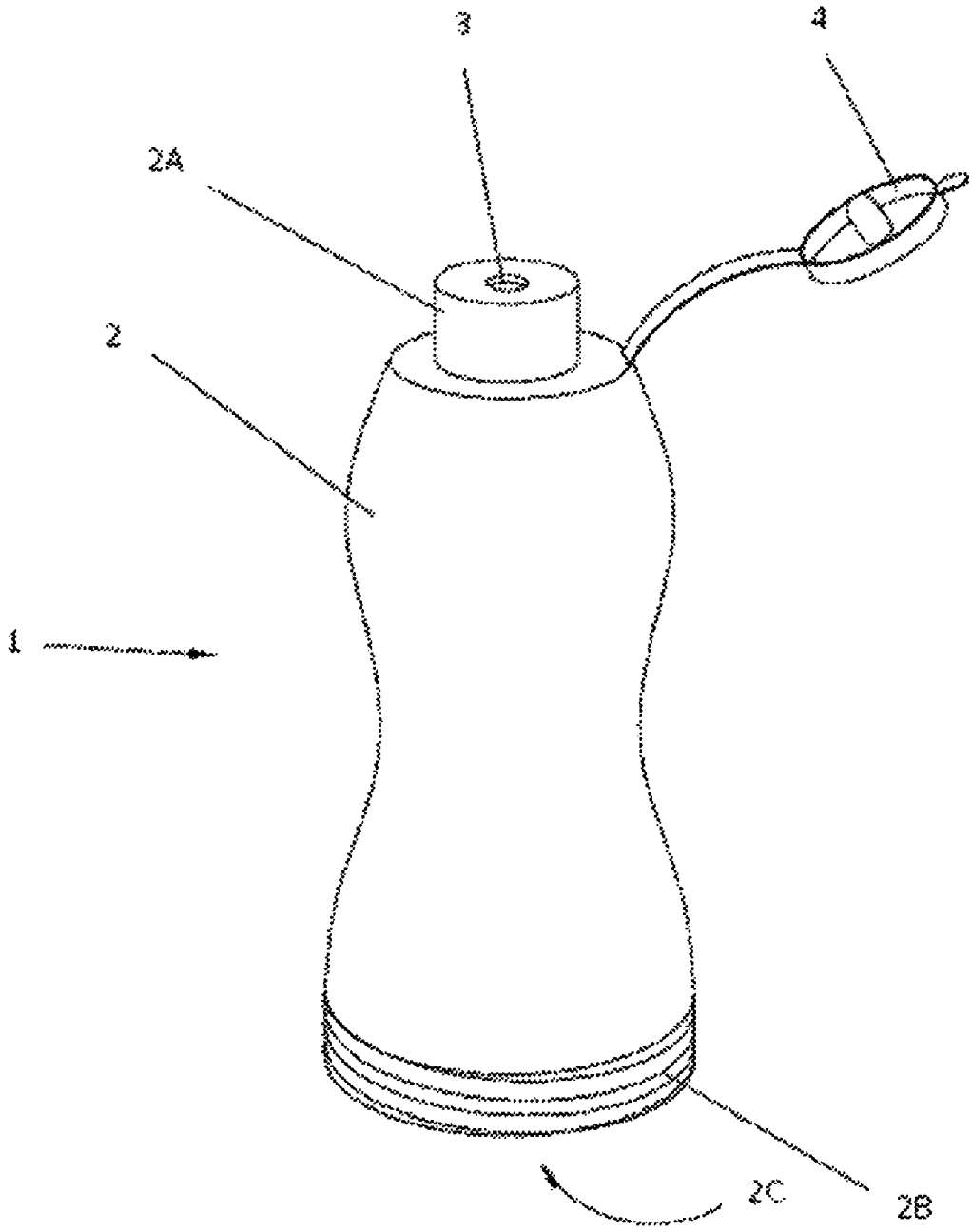
FIG. 1 shows a dispensing container for liquids or gels standing on a surface.

Referring to FIG. 1 there is shown a dispensing container in the form of a "squeeze to use" shampoo bottle 1. The bottle forms a dispenser for shampoo and has a waisted housing 2 with a first end in the form of a projection 2A with a dispensing aperture 3 in the centre of the projection 2A to dispense shampoo. An aperture sealing cap 4 is also provided. Housing 2 has a first component in the form of an opposing threaded base and closed second end 2B. Bottle 1 stores shampoo, and it has an inner wall in contact with shampoo to be dispensed. Surface contact means in the form of a flat base 2C at the second end 2B of the container opposing said first end allowing the container to stand on its own on a surface on the base 2C without need for a support member. Bottle 1 may however also be used with a support member such as in FIG. 2. In this respect the shampoo bottle 1 may be mounted within a support member, such as support member 20 in FIG. 2, with its dispensing aperture 3 facing downwards whereby convenient access is provided around the bottle, allowing shampoo to be dispensed by squeezing the bottle 1 with one hand only. Instead of storing shampoo, bottle 1 could equally store other gels or liquids such as sauces, e.g. tomato ketchup. Sealing plug 4 seals the dispensing aperture 3 to prevent spillage of the liquid or gel.

Figure 2:
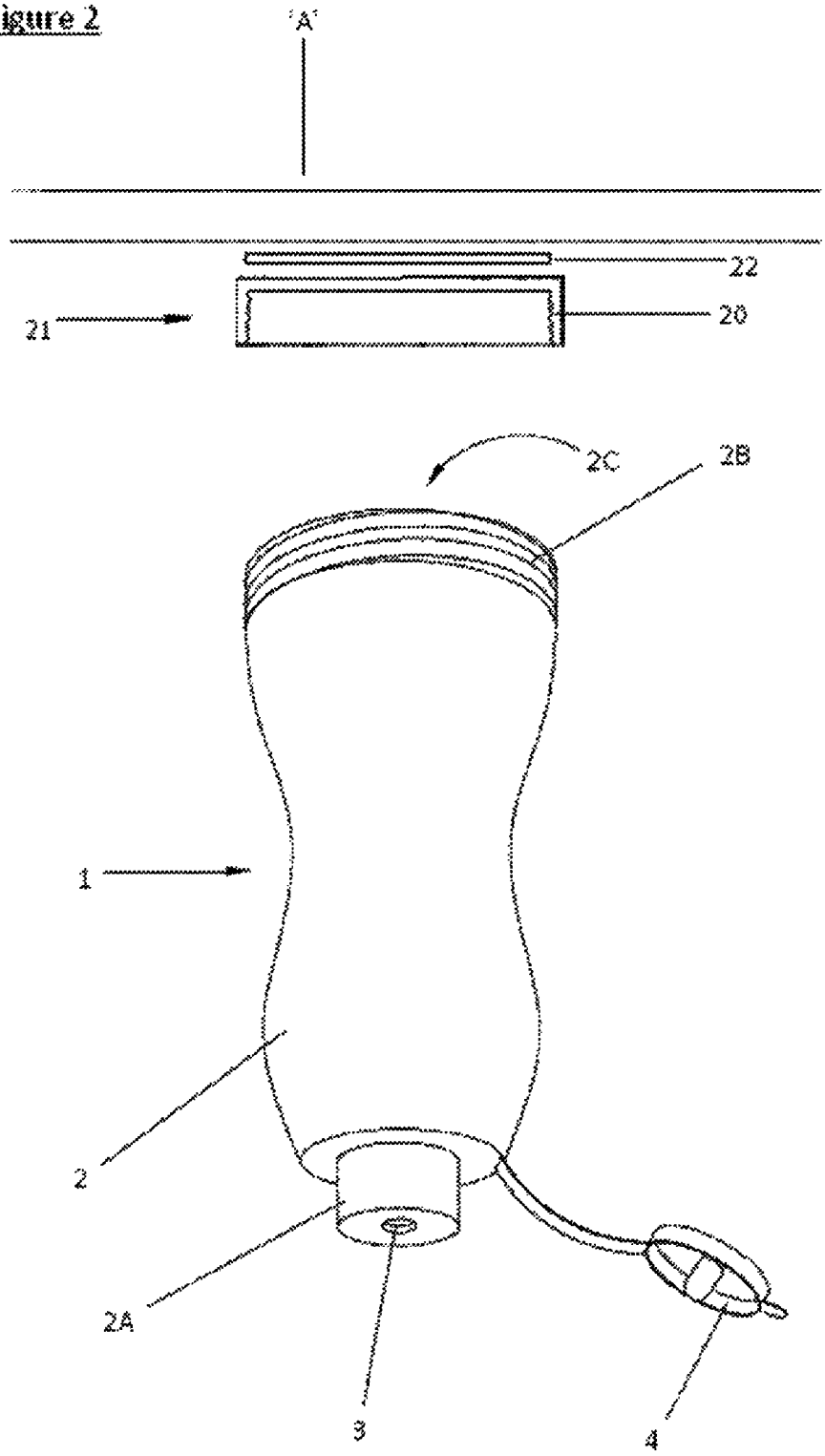
FIG. 2 shows a dispensing container in the form of shampoo bottle and a support member mounted under a surface.

Referring to FIG. 2, a support member 20 has a second component in the form of an internally threaded base 21 to engage with threaded second end 2B of housing 2. Base 21 has an upper face a layer of self adhesive 22 to enable the base 21 to engage with the underneath of a horizontal surface such as a shelf or bottom of a cupboard "A". The bottle 1, referred to in FIG. 1, when engaged with base 21, can depend below the surface with dispensing aperture 3 pointing down. Instead of adhesive 22, another non invasive fixing such as suction pads could be used.

Threaded second end 2B and the thread on base 21 act as an engagement means to connect the bottle 1 to the support member 20. The threaded second end 2B releasably interlocks with the threaded base 21 on the support member.

The engagement means provided by the threading on the second end 2B and base 21 predetermines the orientation of the body 2 relative to the support member such that the sealing plug faces away from the user.

The thread on the second end 2B is easily detected by touch alone. Thus, a user with impaired sight can easily feel which end of the bottle is to be introduced and screwed into the support 20, and the bottle 1 engaged in this manner will be correctly oriented for dispensing the contents of the bottle. A user with impaired sight may also use the feel of the thread on the second end to distinguish the second end from the first end by touch alone even when the bottle is not in use with the support member.

Figure 3:
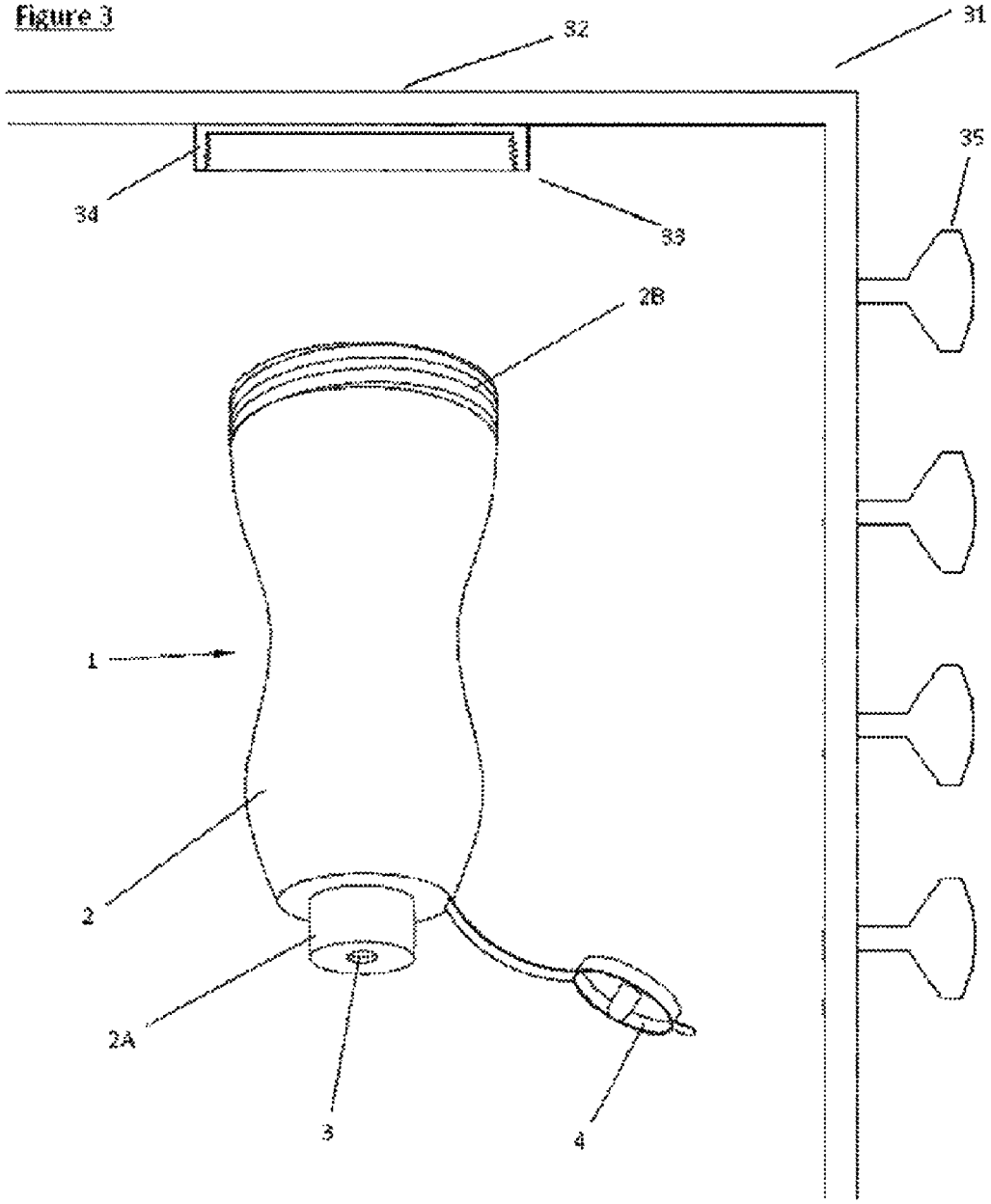
FIG. 3 shows a dispensing container and a support member attached to a wall

Referring to FIG. 3, the support member 31 has a shelf-like projection 32 which has a second component 33 in the form of an internally threaded base 34 to engage with the threaded second end 2B of housing 2 of the bottle featured in FIG. 1. The bottle 1, when engaged with base 33, can depend below the surface with dispensing aperture 3 pointing down. The support member is firmly held to the support structure by suction pads 35.

The shelf-like projection 32 provides a structure that may further be utilised, for example, providing a soap dish or place to keep sponges and other shower paraphernalia.

It is envisaged that a user would purchase a dispensing container (e.g. shampoo or gel) and one or more support members. The container could first be used with the first support member in one environment and later transferred to a second support member in another environment, or vice versa. Alternatively the container could first be used with the first support member in one environment, and then can stand on its own on its surface contact means.

The components of the dispensing container system having the container, support member, and the engagement means, could be purchased in combination or singly.

Further modifications will be apparent to those skilled in the art without departing from the scope of the present invention.

The invention claimed is:

1. A support member and dispensing container assembly for gels or liquids comprising:

a support member which rigidly attaches to a support structure which has an engagement means to releasably hold a container to form a rigid connection whereby the dispensing end of the container faces downwards, enabling a user unrestricted access to the sides of the container to enable product to be squeezed from the container:

a free standing, self contained, fully sealed squeeze to use dispensing container for gels or liquids featuring a dispensing aperture at one first end of the container to dispense product, which can be connected to and released from the support member solely by holding and manipulating the dispensing container relative to the support member; and an engagement means comprising a pre-moulded first component on the dispensing container second end which releasably interlocks with a second component on the support member by rotating the first component relative to the second component and then unlocks by rotating the first component relative to the second component in the opposite direction, the interlocking means between the first and second components comprising a structure selected from the group consisting a key or key way, screw thread, bayonet style connector or other rotating interlocking action; and a dispensing container with a surface contact means at a second end of the container opposing said first end allowing the dispensing container to stand on a surface on the surface contact means.

2. An assembly for dispensing liquids or gels comprising:

a dispensing container for gels or liquids which is free standing and fully sealed, the dispensing container having a first end from which a dispensing aperture dispenses a liquid or gel when the dispensing container is squeezed, and a second end which features a first engagement component, and a main axis between the first end and the second end, a support member capable of being rigidly attached to a support structure, and having a second engagement component, the first engagement component and the second engagement component being capable of co-operating to releasably and rigidly hold the container so that the dispensing end of the container faces downwards, the first engagement component capable of interlocking with the second engagement component by rotating the first engagement component relative to the second engagement component in a first direction about the main axis, and thereafter the first engagement component capable of unlocking from the second engagement component by rotating the first engagement component relative to the second engagement component in a second opposite direction about the main axis.

3. An assembly according to claim 2, wherein the rotation of the first engagement component relative to the second engagement component in is the horizontal plane.

4. An assembly according to claim 2, wherein the first engagement component and second engagement component comprises a key or keyway, a screw thread or a bayonet style connector.

5. An assembly according to claim 2, wherein the container does not feature a through hole.

6. An assembly according to claim 2, wherein the first engagement component on the dispensing container is insertable into the second engagement component on the support member.

7. An assembly according to claim 2, wherein the second engagement component on the support member is insertable into the first engagement component on the dispensing container.

8. An assembly according to claim 2, wherein the dispensing container is shaped at the first end of the container to allow the container to freely stand on the first end.

9. An assembly according to claim 2, wherein the dispensing container is shaped at the second end of the container opposing the first end to allow the container to freely stand on the second end.

10. An assembly according to claim 2, wherein the first end of the container includes a cap which can be removed and fitted onto the second end of the container, enabling the dispensing container to fit into the second engagement component to form a rigid connection.

11. An assembly according to claim 2, wherein the engagement means predetermines the orientation of the dispensing container relative to the support member.

12. An assembly according to claim 2, wherein the support member is adapted to be mounted under a surface whereby the dispensing container can depend below the surface.

13. An assembly according to claim 2, wherein the support member is non-invasively attached to the support structure.

14. An assembly according to claim 2, wherein the support member features an adhesive surface to secure the support member to a support structure.

15. An assembly according to claim 2, comprising a support member which can be secured to a support structure using suction pads.

16. A support member and dispensing container system according to claim 2, comprising a support member that can be secured to a vertical surface by means of an adhesive layer or suction pads.

17. An assembly according to claim 2, wherein the dispensing container can be inserted into the second engagement component with a single hand.

18. An assembly according to claim 2, wherein the dispensing container can be removed from the second engagement component with a single hand.

19. An assembly according to claim 2, wherein the dispensing container can be inserted into the second engagement component with a single action.

20. An assembly according to claim 2, wherein the dispensing container can be removed from the second engagement component with a single action.

* * * * *